US005520756A

United States Patent [19]

Zeigler

[11] Patent Number: 5,520,756

[45] Date of Patent: May 28, 1996

[54] STABLE PLASTICIZERS FOR NITROCELLULOSE NITROGUANIDINE-TYPE COMPOSITIONS

[75] Inventor: Edward H. Zeigler, Great Meadows, N.J.

[73] Assignee: Hercules Incorporated, Wilmington, Del.

[21] Appl. No.: 962,950

[22] Filed: Oct. 16, 1992

Related U.S. Application Data

[63] Continuation-in-part of Ser. No. 625,513, Dec. 11, 1990, abandoned.

[51] Int. Cl.[6] ..... C06B 45/10; C06B 21/00

[52] U.S. Cl. ..... 149/19.8; 149/19.7; 149/19.91; 149/19.92; 149/92; 264/3.3

[58] Field of Search ..... 149/19.4, 19.8, 149/19.7, 19.91, 19.92; 264/3.3

[56] References Cited

U.S. PATENT DOCUMENTS

| | | | |
|---|---|---|---|
| 2,461,582 | 2/1949 | Wright et al. | 260/467 |
| 2,485,855 | 10/1949 | Bloomquist et al. | 260/467 |
| 2,698,228 | 12/1954 | Kincaid et al. | 52/13 |
| 3,378,611 | 4/1968 | Kineaid et al. | 264/3 |
| 3,658,608 | 4/1972 | Low | 149/19 |
| 3,798,090 | 3/1974 | Allabashi | 149/19.8 |
| 3,856,590 | 12/1974 | Kincaid et al. | 149/19.8 |
| 3,894,894 | 7/1975 | Slrick | 149/19.8 |
| 4,014,720 | 3/1977 | Wells | 149/19.8 |
| 4,092,188 | 5/1978 | Lovelace | 149/19.8 |
| 4,139,404 | 2/1979 | Goddard | 149/19.8 |
| 4,298,411 | 11/1981 | Godsey | 149/19.4 |
| 4,381,958 | 5/1983 | Howard | 149/19.8 |
| 4,386,978 | 6/1983 | Baczuk et al. | 149/19.4 |
| 4,450,110 | 5/1984 | Simmons et al. | 149/92 |
| 4,457,791 | 7/1984 | Gill et al. | 149/19.8 |
| 4,915,755 | 4/1990 | Kim | 149/19.4 |
| 4,938,813 | 7/1990 | Eisele et al. | 149/92 |
| 4,961,380 | 10/1990 | Flanagan et al. | 149/19.92 |
| 5,186,770 | 2/1993 | Adams et al. | 149/92 |
| 5,325,782 | 7/1994 | Strauss et al. | 149/19.4 |

FOREIGN PATENT DOCUMENTS

| | | |
|---|---|---|
| 2038796 | 1/1979 | United Kingdom . |
| 1588605 | 4/1981 | United Kingdom . |

*Primary Examiner*—Edward A. Miller
*Attorney, Agent, or Firm*—Haugen and Nikolai

[57] ABSTRACT

Stable plasticizer system and corresponding nitrocellulose/nitroguanidine nitramine-type LOVA propellant compositions utilizing such system.

19 Claims, No Drawings

STABLE PLASTICIZERS FOR NITROCELLULOSE NITROGUANIDINE-TYPE COMPOSITIONS

This application is a continuation-in-part of application Ser. No. 07/625,513, filed Dec. 11, 1990, now abandoned.

The present invention relates to stable propellant compositions of low sensitivity comprising matter and energy adjustment/plasticizer components and the corresponding method for improving storage life by utilizing a stable plasticizer system.

BACKGROUND OF THE INVENTION

Most conventional propellants, particularly gun propellants, utilize a matrix component such as nitrocellulose plus nitrate esters such as nitroglycerine, and/or nitroguanidine, forming high energy compositions which, unfortunately, can be set off or initiated by sympathetic detonation such as by a neighboring explosion. Because of the potential danger in storing large amounts of propellants of such type, there has been a long standing research effort to reduce propellant sensitivity without significant sacrifice in energy content (e.g. heat of explosion) or loss of desired ballistic characteristics.

One promising approach for developing less sensitive gun propellants has involved the use of high-energy nitramines such as alkylnitrato nitramines as substitutes for sensitive esters such as nitroglycerine in multi-based propellants.

Nitramines of such type, their substitution and preparation, are disclosed, for instance, in U.S. Pat. No. 2,461,582 of Wright et al. and U.S. Pat. No. 2,485,855 of Blomquist et al., in which an ethanol-amine or N-alkyl substituted ethanol-amine plus acetic anhydride are used as reactants.

As noted in Blomquist, however, there is a tendency for such high energy nitramines to migrate and crystallize out of a colloided matrix such as nitrocellulose during storage, resulting in substantial unplanned changes in sensitivity and ballistic properties.

In the present invention this tendency of the nitramines to crystallize out of the matrix is avoided, consequently improving the storage stability of the propellant. The present invention is a high energy nitramine-type plasticizer system suitable for use with nitrocellulose/nitroguanidine-type double base propellant.

This invention also provides a gun propellant composition of low sensitivity containing nitrocellulose/nitroguanidine or other energy adjustment component combined with nitroxyalkyl nitramine plasticizer.

The present invention is a propellant composition, and the method of making it, wherein the composition comprises A. a matrix component, such as nitrocellulose, B. an energy adjustment component; and C. an effective amount of plasticizer component capable of gelation of the matrix component and comprising two nitratoalkyl nitramines:

i. a high energy nitratoalkyl nitramine (i.e. based on heat of explosion) of the formula $$R-\underset{\underset{NO_2}{|}}{N}\text{-Alk-}O-NO_2 \qquad (I)$$

in which R is defined as —Alk—O—$NO_2$, H, or a 1–2 carbon monovalent aliphatic group; and Alk is individually defined as a 1–2 carbon divalent aliphatic chain; wherein said high energy alkyl nitramine being at least partly soluble or miscible in a second nitratoalkyl nitramine; and ii. said second nitratoalkyl nitramine having a lower energy content (i.e. heat of explosion) than the high energy nitramine component of Formula I and represented by the formula $$R'-\overset{\overset{NO_2}{|}}{N}-(CH_2)_nO-NO_2 \qquad (II)$$

in which R' is individually defined as a 2–5 carbon monovalent aliphatic group of different molecular structure from the R group of formula I and n is a positive integer not exceeding about 2.

The ratio of matrix component A/energy component B/plasticizer component C of the propellant composition is about 4–5/1–2/3–4 in parts by weight based on propellant composition, in the cumulative presence of up to about 6% by weight, based on propellant composition, of one or more conventional additives including stabilizers such as ethyl centralite, opacifiers such as carbon black, and flash suppressants such as $KNO_3$ or $K_2SO_4$.

For present purposes the ratio by weight of high energy nitratoalkyl nitramine-to-nitramine of lower energy content in the (C.) component is preferably about 1–5 to 5–1 in parts by weight, and the R and R' substituent groups within formulae I and II are molecularly dissimilar in each plasticizer component.

Of particular interest, for purposes of the present invention, is the use of normally solid high energy nitratoethyl nitramine ingredients in which the definition of R in formula I is nitratoethyl or methyl, and Alk is —$CH_2CH_2$—, while the R' group (formula II) is preferably a 2 to 4 carbon monovalent alkyl group such as an ethyl, propyl, butyl or pentyl substituent. The mixture of plasticizers is adjusted to balance the energy requirements met by the higher energy nitramine with the enhancement of the solubility of the plasticizer provided by the lower energy nitramine. In the absence of the lower energy component, the higher energy component tends to crystalize on the surface of the propellant. This can lead to disadvantages such as variable burning rates, a large difference in physical properties as well as ballistic properties being affected above and below the melting point of the higher energy plasticizer and sensitivity problems caused by the exudation of the higher energy plasticizer in stored propellant that is exposed to prolonged cycling of temperatures in storage.

The term "matrix component" for purposes of the present invention can include one or more polymers selected from the group consisting of nitrocellulose, cellulose acetate, cellulose acetate butyrate, ethyl cellulose, ethyl acrylate-based polymer, and styrene-acrylate type copolymer.

The term "energyadjustment component," for present purposes, comprises generally insoluble energetic solids such as one or more of nitroguanidine, cyclotrimethylene trinitramine (RDX), cyclotetramethylene tetranitramine (HMX) and ethylene dinitramine (EDNA) and similar recognized components. The term "effective amount", for purposes of the present invention, is defined as about 25%–65% by weight of binder component of the propellant composition (binder not including solids).

Nitratoethyl nitramines of interest for purposes of formula I and II components along with pertinent, physical characteristics are presented in Tables I and II below, in which the energy content of each component is set out as calculated heat of explosion in cal/gm.

TABLE I $$R-\underset{\underset{NO_2}{|}}{N}-Alk-O-NO_2 \quad (1)$$

| Cpd[1] | R | Physical Form | Melting Point (°C.) | Calculated Heat of Explosion cal/gm |
|---|---|---|---|---|
| 1 | nitratoethyl | solid | 52.5 | 1337 |
| 2 | methyl | solid | 38 | 1113 |
| 3 | ethyl | liquid | 5 | 784 |

[1]Assuming use of lower energy formula II component in which it is at least partly soluble or miscible.

TABLE II $$R'-\underset{\underset{NO_2}{|}}{N}-(CH_2)_n-O-NO_2 \quad (II)$$

| Cpd | R' | Physical Form at Room Temp | Melting Point (°C.) | Calculated Heat of Explosion cal/gm |
|---|---|---|---|---|
| 4 | ethyl | liquid | 5 | 784 |
| 5 | propyl | liquid | −2 | 503 |
| 6 | butyl | liquid | −25 | 259 |
| 7 | pentyl | liquid | −30 | 47 |

TABLE III

| Cpd# | Physical Form | Solubility Parameter |
|---|---|---|
| 1 | Solid | 13.1 |
| 2 | Solid | 13.2 |
| 3(4) | liquid | 11.4 |
| 5 | liquid | 11.0 |
| 6 | liquid | 10.6 |
| 7 | liquid | 10.4 |

The compounds set forth in Tables I-III are relatively active plasticizers for nitrocellulose and other polymers commonly used as gun propellant ingredients. The relative compatibility (solubility) of a plasticizer in a polymer can be represented by its solubility parameter compared to that of the polymer, i.e., the solubility parameters need to be close together for the plasticizer to be soluble in the polymer. From close inspection of the solubility parameters shown in the table compared to that of nitrocellulose (about 11), the two solid compounds would be less soluble in nitrocellulose than the four liquid ones. If in preparation of a nitrocellulose binder type propellant composition, they were made soluble by a compatibilizing process solvent, then it was found that upon loss of that solvent during drying there was a tendency for exudation and separation. If exudation due to compatibility were to occur, then since the materials are solids, they would tend to remain as solvents on the surface of the propellant at room temperature. In the practice of the present invention, one of the compounds from Table I is dissolved in one of the compounds in Table II to yield a solution that is a liquid at room temperature (70° F.). Preferably, nitratoethyl or methyl nitratoethyl nitramine is dissolved in a nitramine selected from the group consisting of ethyl, propyl, butyl and pentyl nitratoethyl nitramine. Most preferably, the methyl nitratoethyl nitramine is mixed with the ethyl nitratoethyl nitramine.

EXAMPLE I

A. A 50 lb. batch of test propellant composition consisting of nitrocellulose (39.5% by wt.), nitroguanidine (22.5%), ethyl centralite (1.5%), potassium sulfate (1%), carbon black (0.5%) and methyl nitrato ethyl nitramine derivative (35%) of the formula $$CH_3-\underset{\underset{NO_2}{|}}{N}-CH_2-CH_2-O-NO_2 \quad \text{(Cpd 2 Table I)}$$

(obtained from methyl ethanolamine, nitric acid, and acetic anhydride in accordance with the process as described in column 4 of U.S. Pat. No. 2,485,855) was prepared by initially blending nitrocellulose, ethyl centralite, potassium sulfate (1%) and carbon black in indicated amounts with a 50/50 acetone/ethanol solvent at ambient temperature at 25 rpm for about 10 minutes. To this was then added the methylnitrato ethyl nitramine component premixed in 50/50 acetone/ethanol solvent, and the combined material was blended for 1 hour to obtain a colloided nitrocellulose phase. Into this phase was slowly mixed dry nitroguanidine component and blended for about 1 hour, to obtain a homogeneous dough-like consistency. The dough was then put through a 4-inch extrusion press having a plurality of 0.45 inch diameter die holes to obtain corresponding extruded strands which were then conventionally cut into 0.6" lengths, air dried at room temperature for 1 day, and then subjected to a 55° C. long drying phase for 3 days. The resulting granular propellent is stored at ambient temperature and examined after 1 week. Observed results are reported in Table IV below.

B. The process of Example IA, was repeated using 46.5 parts by weight of the methyl nitratoethyl nitramine mixed with 52.5 parts nitrocellulose and 1 part ethyl centralite stabilizer. No nitroguanidine was added. After drying and storage steps identical to Example 1A, the propellant was evaluated and results reported in Table IV below.

C. The process of Example IA was repeated using 25 parts by weight of the methyl nitratoethyl nitramine mixed with 74 parts of nitrocellulose and 1 part of ethyl centralite. After drying and storage steps identical to Ex. 1A, the propellant was evaluated and results reported in Table IV below.

D. The process of Example IA, was repeated except that the relative amounts and the type of insoluble, energetic solid were mixed as follows, with respect to nitrocellulose (16.1%), nitroguanidine (26.5%), cyclonite or RDX (47.9%), ethyl centralite (0.4%), carbon black (0.1%), $KNO_3$ (1%), the methyl nitratoethyl nitramine (4.6%) (cpd 2, Table I) and the ethyl nitratoethyl nitramine (3.4 %) (cpd 4, Table II). The observed results are reported in Table IV below.

E. The process of Example IB was repeated except that the relative amounts of ingredients were mixed as follows, with respect to nitrocellulose (47.8%), nitroguanidine (15%), ethyl centralite (1%), $KNO_3$ (1%), carbon black (0.2%), the methyl nitrato ethyl nitramine (20%) (cpd 2, Table 1) and the ethyl nitrato ethyl nitramine (10%) (Cpd 4 Table II). The observed results are reported in Table IV below.

TABLE IV

| Example | Observed Surface[2] Crystallization |
|---|---|
| 1A | (++) |
| 1B | (++) |

TABLE IV-continued

| Example | Observed Surface[2] Crystallization |
|---|---|
| 1C | (+) |
| 1D | (–) |
| 1E | (–) |

[2](++) = substantial observed surface crystallization after 1 week storage
(+) = trace of surface crystallization after 1 week storage
(–) = no observed surface crystallization after 1 week storage

I claim:

1. A propellant composition consisting essentially of

A. a matrix component consisting essentially of one or more components selected from the group consisting of one or more of nitrocellulose, cellulose acetate, cellulose acetate butyrate, ethyl cellulose, ethyl acrylate-based polymer, and styrene acrylate type copolymer;

B. an energy adjustment component consisting essentially of one or more nitramine components; and C. an effective amount of plasticizer component to accomplish gelation of said matrix component and prevent crystallization of said energy adjustment component, wherein said plasticizer component consists essentially of nitratoalkyl nitramines including at least two nitratoalkyl nitramins as follows:

i. a high energy nitratoalkyl nitramine of the formula $$R-\underset{\underset{NO_2}{|}}{N}\text{-Alk-O}-NO_2 \qquad (I)$$

in which R is defined as —Alk—O—$NO_2$, H, or a 1–2 carbon monovalent aliphatic group; and Alk is individually defined as a 1–2 carbon divalent aliphatic chain; said high energy alkyl nitrato-nitramine, being at least partly soluble or miscible in a second nitratoalkyl nitramine; and ii. a second nitrato alkyl nitramine having a lower energy content that said high energy nitrato alkyl nitramine component, and represented by the formula $$R'-\overset{\overset{NO_2}{|}}{N}-(CH_2)_nO-NO_2 \qquad (II)$$

in which R' is individually defined as a 2–5 carbon monovalent aliphatic group of different molecular structure from the R group of formula (I) and n is defined as a positive integer not exceeding 2;

D. wherein the ratio of A./B./C. components of said propellant composition being about 4–5/1–2/2–4 in parts by weight based on propellant composition in the cumulative presence of up to about 6% by weight, based on propellant composition, of one or more additives selected from the group consisting of a stabilizer, an opacifier, and a flash suppressant; and E. wherein said plasticizer component and said matrix component have solubility parameters at room temperature sufficiently consistent to maintain the gelation of said matrix component and prevent migration and crystallization of said energy adjustment component.

2. The propellant composition of claim 1 wherein the ratio by weight of said matrix component A/energy adjustment component B/plasticizer component C is about 4.5/1.5/2.0 based on propellant composition.

3. The propellant composition of claim 1 wherein the ratio by weight of said A/B/C components is about 4.8/1.5/3.5, based on propellant composition.

4. The propellant composition of claim 1, wherein the ratio by weight of A/B/C components is about 5.0/2.0/4.0 based on propellant composition.

5. The propellant composition of claim 1 wherein said energy adjustment component is selected from the group consisting of nitroguanidine, cyclotrimethylene trinitramine, cyclotetramethylene tetranitramine and ethylene dinitramine.

6. The propellant composition of claim 2, wherein the energy adjustment component is nitroguanidine and the matrix component is nitrocellulose.

7. The propellant composition of claim 3, wherein the energy adjustment component is nitroguanidine and the matrix component is nitrocellulose.

8. The propellant composition of claim 4, wherein the energy adjustment component is nitroguanidine and the matrix is nitrocellulose.

9. The propellant composition of claim 1 wherein the ratio by weight of high energy nitrato alkyl nitramine-to-second nitramine in the plasticizer component is about 1–5 to 5–1, R is defined as a $$NO_2-O-CH_2-CH_2-\underset{\underset{NO_2}{|}}{N}-,$$

$CH_3$—, or a $C_2H_5$— substituent group and n (of formula II) is defined as 2.

10. The propellant composition of claim 2 wherein the ratio by weight of high energy nitrato alkyl nitramine-to-second nitratoalkyl nitramine in the plasticizer component is about 2-to-1.5, R is defined as a $$NO_2-O-CH_2-CH_2-\underset{\underset{NO_2}{|}}{N}-,\ CH_3-,\ \text{or}$$

a $C_2H_5$— substituent group; and n (formula II) is defined as 2.

11. The propellant composition of claim 3 wherein the ratio by weight of high energy nitrato alkyl nitramine-to-second nitratoalkyl nitramine in the plasticizer component is about 2to-1.5 and R is defined as a $$NO_2-O-CH_2-CH_2-\underset{\underset{NO_2}{|}}{N}-,\ CH_3-\ \text{or}$$

$C_2H_5$— group, and n is defined as 2.

12. The propellant composition of claim 4 wherein the ratio by weight of high energy nitratoalkyl nitramine-to second nitrato-alkyl nitramine in the plasticizer component is about 2 to 1.5, R is defined as a $$NO_2-O-CH_2-CH_2-\underset{\underset{NO_2}{|}}{N}-,\ CH_3-,\ \text{or}$$

$C_2H_5$— group, and n is defined as 2.

13. The propellant composition of claim 9 herein R' (formula II) is defined as a $C_2H_3$—, $C_3H_7$— $C_4H_9$— or $C_5H_{11}$— substituent group.

14. The propellant composition of claim 10 wherein R' (formula II) is defined as a $C_2H_5$—, $C_3H_7$—, $C_4H_9$— or $C_5H_{11}$— substituent group.

15. The propellant composition of claim 11 wherein R' (formula II) is defined as a $C_2H_5$—, $C_3H_7$—, $C_4H_9$— or $C_5H_{11}$— substituent group.

16. A method for improving the storage life of double based low sensitivity propellant composition comprising a matrix component, an energy adjustment component, and a nitratoalkyl nitramine plasticizer component, the improvement comprising selecting two nitratoalkyl nitramine plasticizer components of different energy in order that a solution of said plasticizer components has about the same solubility parameter as said matrix component at 70° F. wherein said method comprises:

a) initially dissolving at least one high energy nitratoalkyl nitramine of the formula

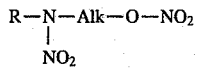

$$R-\underset{\underset{NO_2}{|}}{N}-Alk-O-NO_2 \quad (I)$$

in which R is defined as —Alk—O—$NO_2$, H, or a 1–2 carbon monovalent aliphatic group, and Alk is individually defined as a 1–2 carbon divalent aliphatic chain; at least in part into a second nitrato alkyl nitramine component having a lower energy content than said nitramine of formula I and represented by the formula

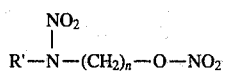

$$R'-\overset{\overset{NO_2}{|}}{N}-(CH_2)_n-O-NO_2 \quad (II)$$

in which R' is defined as a 2–5 carbon monovalent aliphatic group of different molecular structure from the R group of said high energy nitramine component, and n is defined as a positive integer not exceeding 2;

(b) admixing and blending the resulting combined plasticizer component into said matrix component to obtain a dough-like mixture;

(c) blending an energy adjustment component into said dough-like mixture to obtain an extrudable essentially homogeneous mass;

(d) extruding said essentially homogeneous mass to obtain strands of propellant material and (e) cutting and drying said strands to obtain the desired propellant composition.

17. The method of claim 16 wherein the matrix component is nitrocellulose and the ratio of high energy nitratoalkyl nitramine (formula I)-to-second nitratoalkyl nitramine (formula II) in said plasticizer component is about 1–5 to 5–1.

18. The method of claim 16 wherein the high energy nitramine of formula I and the second nitrato alkyl amine of formula II are initially dissolved in a common solvent system prior to blending into said matrix component.

19. The method of claim 18 wherein the common solvent system is an acetone/alcohol mixture.

* * * * *